US010336513B2

(12) United States Patent
Wodka

(10) Patent No.: US 10,336,513 B2
(45) Date of Patent: Jul. 2, 2019

(54) LID HAVING A PRE-VENTING LID LEVER AND A SEAL ARM ASSEMBLY

(71) Applicant: IGNITE USA, LLC, Chicago, IL (US)

(72) Inventor: Daniel M. Wodka, Chicago, IL (US)

(73) Assignee: IGNITE USA, LLC, Chicago, IL (US)

( * ) Notice: Subject to any disclaimer, the term of this patent is extended or adjusted under 35 U.S.C. 154(b) by 0 days.

(21) Appl. No.: 15/442,219

(22) Filed: Feb. 24, 2017

(65) Prior Publication Data

US 2018/0244441 A1 Aug. 30, 2018

(51) Int. Cl.

| | |
|---|---|
| ***A47G 19/22*** | (2006.01) |
| ***B65D 47/24*** | (2006.01) |
| ***B65D 43/02*** | (2006.01) |
| ***B65D 43/16*** | (2006.01) |
| ***B65D 43/26*** | (2006.01) |
| ***B65D 47/08*** | (2006.01) |
| ***B65D 47/32*** | (2006.01) |
| ***B65D 51/18*** | (2006.01) |
| ***B65D 51/16*** | (2006.01) |

(52) U.S. Cl.

CPC ..... *B65D 47/245* (2013.01); *A47G 19/2272* (2013.01); *B65D 43/02* (2013.01); *B65D 43/16* (2013.01); *B65D 43/265* (2013.01); *B65D 47/0857* (2013.01); *B65D 47/249* (2013.01); *B65D 47/32* (2013.01); *B65D 51/1683* (2013.01); *B65D 51/18* (2013.01); *B65D 2251/009* (2013.01); *B65D 2251/0021* (2013.01); *B65D 2251/0025* (2013.01); *B65D 2251/0028* (2013.01); *B65D 2251/0081* (2013.01); *B65D 2251/0087* (2013.01); *B65D 2543/00046* (2013.01); *B65D 2543/00296* (2013.01)

(58) Field of Classification Search

CPC ..... B65D 47/245; B65D 43/02; B65D 43/16; B65D 43/265; B65D 47/0857; B65D 47/32; B65D 51/18; B65D 2251/0021

USPC ..... 220/254.2, 714, 715, 254.5

See application file for complete search history.

(56) References Cited

U.S. PATENT DOCUMENTS

| | | | | |
|---|---|---|---|---|
| 4,136,799 | A * | 1/1979 | Albert | B65D 47/249 215/315 |
| 6,352,166 | B1 | 3/2002 | Copeland | |
| D500,428 | S | 1/2005 | Ward et al. | |

(Continued)

OTHER PUBLICATIONS

Design U.S. Appl. No. 29/557,014, filed Mar. 4, 2016, "Lid for Beverage Container with Straw Holder".

(Continued)

*Primary Examiner* — J. Gregory Pickett
*Assistant Examiner* — Niki M Eloshway
(74) *Attorney, Agent, or Firm* — Marshall, Gerstein & Borun LLP

(57) ABSTRACT

A lid includes a lid lever and a seal arm assembly that stage opening of a vent hole relative to a drink hole so that vapor within the liquid container may be vented to the atmosphere before the drink hole is opened. As the lid lever is rotated a first direction, beginning from a closed position, the lid lever rotates a small amount independently of the seal arm assembly to open a vent hole before contacting the seal arm assembly to open a drink hole. As the lid lever is rotated in a second direction, from an open position, the lid lever and the seal arm assembly rotate in unison until the drink hole is closed.

18 Claims, 4 Drawing Sheets

(56) References Cited

U.S. PATENT DOCUMENTS

| | | | | |
|---|---|---|---|---|
| D509,408 | S | 9/2005 | Ward et al. | |
| 7,011,227 | B2 | 3/2006 | Ward et al. | |
| 7,546,933 | B2 | 6/2009 | Pinelli | |
| 8,360,258 | B2 * | 1/2013 | Gilbert | A47G 19/2272 220/203.05 |
| 8,573,431 | B2 * | 11/2013 | Shepard | A47G 19/2272 215/315 |
| 8,727,176 | B2 | 5/2014 | El-Saden et al. | |
| D732,337 | S | 6/2015 | Coon et al. | |
| 9,521,918 | B2 | 12/2016 | Coon et al. | |
| 9,908,687 | B2 * | 3/2018 | Chiou | B65D 83/22 |
| 2006/0226160 | A1 | 10/2006 | Elsaden et al. | |
| 2007/0210093 | A1 * | 9/2007 | Pinelli | A47G 19/2272 220/715 |
| 2012/0103987 | A1 | 5/2012 | Lucas | |
| 2012/0325815 | A1 | 12/2012 | Gilbert et al. | |
| 2013/0062358 | A1 * | 3/2013 | El-Saden | A47G 19/2272 220/715 |
| 2013/0119060 | A1 * | 5/2013 | Chiou | B65D 43/02 220/254.3 |
| 2013/0140309 | A1 * | 6/2013 | George | A47G 19/2272 220/254.1 |
| 2015/0201776 | A1 * | 7/2015 | Elsaden | A47G 19/2272 220/715 |
| 2017/0099969 | A1 | 4/2017 | Coon et al. | |
| 2017/0144808 | A1 * | 5/2017 | Choltco-Devlin | B65D 43/26 |
| 2017/0253395 | A1 * | 9/2017 | Matthis | A47G 19/2272 |
| 2017/0253397 | A1 * | 9/2017 | Coon | B65D 47/32 |

OTHER PUBLICATIONS

Design U.S. Appl. No. 29/556,997, filed Mar. 4, 2016, "Lid for Beverage Container".

AUTOCLOSE® Shake & Go®, Flex Tumbler, downloaded from the Internet at: <http://www.gocontigo.com/24-oz-autoclose-shake-and-go-flex-tumbler.html> (applicant admitted prior art).

Snapseal™ Superior, Stainless Steel Travel Mug, downloaded from the Internet at: <http://www.gocontigo.com/20-oz-snapseal-superior-stainless-travel-mug.html> (applicant admitted prior art).

Utility U.S. Appl. No. 15/061,312, filed Mar. 4, 2016, "Dual Drink Mode Lid Assembly for a Container".

* cited by examiner

LID HAVING A PRE-VENTING LID LEVER AND A SEAL ARM ASSEMBLY

FIELD OF THE DISCLOSURE

The disclosure relates generally to a lid for liquid containers, and more particularly, to a re-closable lid for liquid containers, the re-closable lid sequentially opening a vent hole before opening a drink hole when a lid lever is lifted.

BACKGROUND

Refillable beverage containers, such as commuter coffee mugs, for example, typically include a removable lid that includes a fluid aperture or drink hole, and a consumer typically fills the interior of the container (e.g., an insulated container) with a beverage (e.g., coffee) when the lid is removed. To drink the beverage, the consumer typically tips the container to allow the beverage to pass through the drink hole, and the consumer sips the beverage as the beverage exits the drink hole. Because the beverage may be very hot, it is desired to prevent the beverage from spilling out of the drink hole if the container is accidentally tipped. Accordingly, refillable beverage containers can include a selective locking device on the lid that allows fluid to pass through the drink hole only when the locking device is in a desired position. A typical locking mechanism includes a lever or button that is displaced by the consumer prior to (or while) sipping the beverage. However, if such a refillable beverage container is carried in a bag with other items, contact between the items within the bag and the lever or button may accidentally disengage the locking mechanism and cause the beverage to pass through the fluid aperture and onto the items in the bag. Moreover, typical refillable beverage containers have a drinking area adjacent to or surrounding the drink hole that can become dirty with contact from the debris within the bag.

When a hot fluid is placed into the container and the locking mechanism is closed, vapor pressure can build up within the container. When the container is opened, this vapor build up can forcefully exit the drink hole due to the internal-external pressure differential. As a result, a consumer can be inconvenienced or even injured by the exiting hot vapor. To solve this problem, some containers include vent holes to equalize the vapor pressure. However, current containers have vent holes that are always open, which can cause spillage out of the vent hole, or vent holes that are opened simultaneously with the drink hole when the lock is released, which may allow the vapor pressure to vent out of both the vent hole and the drink hole at the same time, again potentially putting the consumer at risk of injury.

BRIEF SUMMARY OF THE DISCLOSURE

A liquid container lid includes a lid lever and a seal arm assembly that stage opening of a vent hole relative to a drink hole so that vapor within the liquid container may be vented to the atmosphere before the drink hole is opened. As the lid lever is lifted (i.e., pivoted in a first direction), beginning from a closed position, the lid lever moves a small amount independently of the seal arm assembly to open a vent hole before contacting the seal arm assembly to open a drink hole. As the lid lever is rotated in a second direction, from an open position, the lid lever and the seal arm assembly rotate in unison until the drink hole is closed.

DETAILED DESCRIPTION

Figure 1:
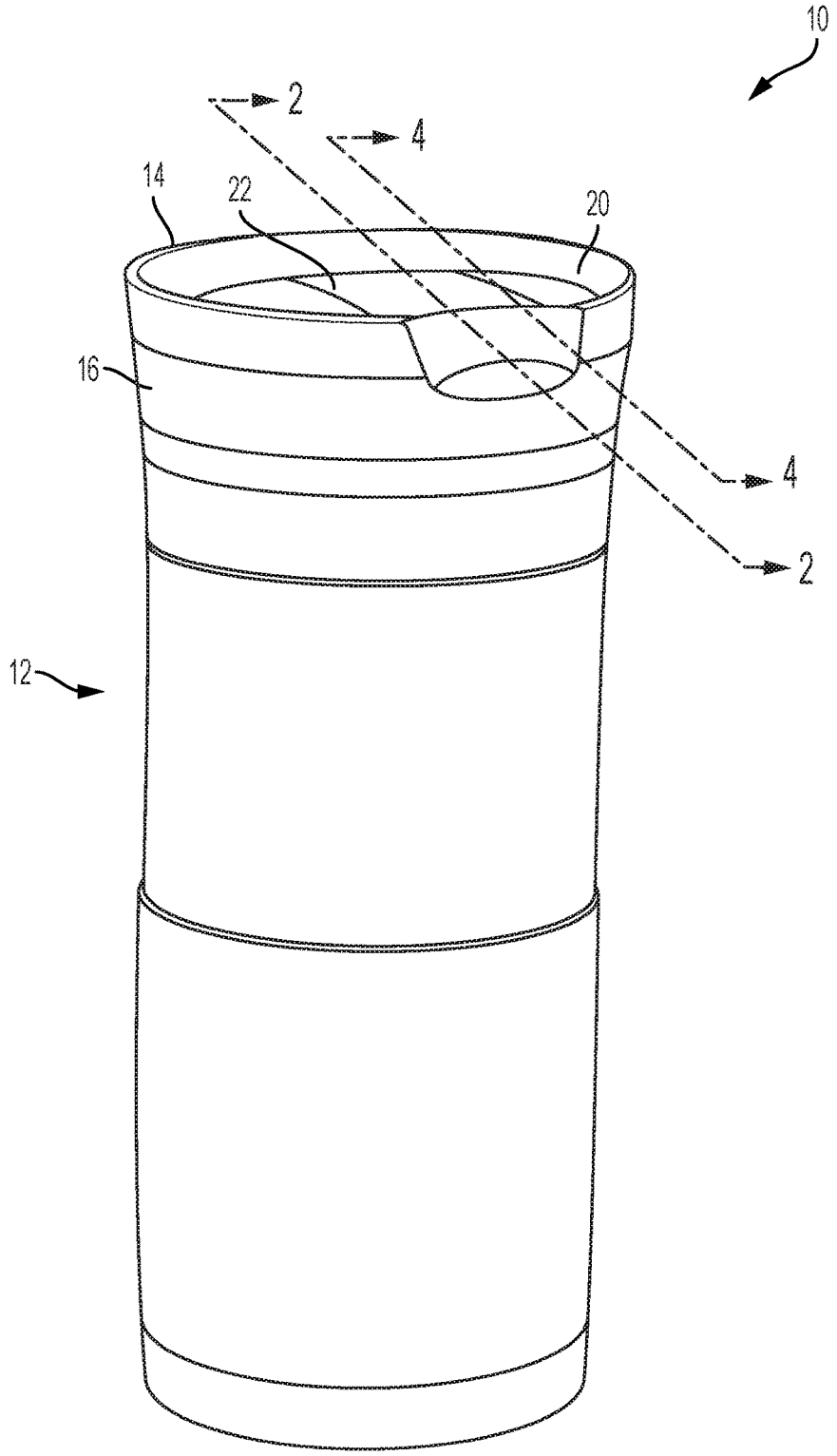
FIG. 1 is a perspective view of one embodiment of a liquid container including a lid having a pre-venting lid lever and a seal arm assembly.

In one aspect, a lid for a liquid container includes a base that is configured for removable attachment to a container. The base includes one or more vent holes and one or more drink holes. A lid lever is pivotably attached to the base, the lid lever including one or more vent plugs that selectively open and close the one or more vent holes. A seal arm assembly is pivotably attached to the base and pivotably movable about a pivot point, the seal arm assembly including a drink plug that selectively opens and closes the one or more drink holes. The lid lever is pivotably movable independently of the seal arm assembly to open the one or more vent holes before the seal arm assembly opens the one or more drink holes.

In another aspect, a liquid container includes a container body having a central chamber and an open end. A lid having a base is configured for removable attachment to the open end of the container. The base includes at least one vent hole and at least one drink hole. A lid lever is pivotably attached to the base, the lid lever including at least one vent plug that selectively opens and closes the at least one vent hole. A seal arm assembly is pivotably attached to the base and pivotably movable about a pivot point, the seal arm assembly including at least one drink plug that selectively opens and closes the at least one drink hole. The lid lever is pivotably movable independently of the seal arm assembly to open the at least one vent hole before the seal arm assembly opens the at least one drink hole.

Any one or more of the foregoing aspects may include any one or more of the following preferred forms.

In one preferred form, the lid lever is independently pivotably movable about 5° or less, for example, about 1° to about 5°, or about 3°, from a closed position before contacting the seal arm assembly.

In another preferred form, the lid lever and the seal arm assembly pivot about a common hinge pin.

In yet another preferred form, the lid lever includes an external tab and an internal extension, the external tab and the internal extension being located on opposing sides of the common hinge pin.

In yet another preferred form, the seal arm assembly includes a rotatable ball element having a shoulder and the internal extension of the lid lever contacts the shoulder of the ball element to cause the lid lever and the seal arm assembly to move in unison.

In yet another preferred form, the at least one vent plug extends away from a surface closest to the base, the at least one vent plug being located on the same side of the lid lever as the external tab.

In yet another preferred form, the lid includes one or more vent seals located in the one or more vent openings. In some preferred forms, the one or more vent seals are formed from a silicone material.

In yet another preferred form, the seal assembly includes a ball plunger located in a recess in a ball element.

In yet another preferred form, the lid includes a plunger bracket located on the base, the plunger bracket resisting movement, so as to prevent the ball plunger from passing the plunger bracket until sufficient force is applied, thereby only allowing the seal arm assembly to move from a closed position to an open position, and vice versa, when sufficient force is applied.

In yet another preferred form, sufficient force to cause the ball plunger to move away from the plunger bracket, and thus to pass the plunger bracket is between 0.5 kg of force and 3.0 kg of force.

Turning now to FIG. 1, a lid 10 may be adapted to be removably secured to a container 12. The container 12 includes a body having a central chamber that is configured to hold a liquid and an open end. The lid 10 is adapted to be removably secured to the open end of the container 12. The lid 10 includes a cap 14 that is secured to a base 16. The base 16 is configured to be releasably secured to the container 12, for example, by a threaded connection. The cap 14 may be generally annular in shape, with a recessed center surface 20. The cap 14 includes a lid lever 22 that is pivotable with respect to the cap 14 to open and close a drink hole (not shown in FIG. 1) when a consumer desires to consume or otherwise extract liquid from the container 12.

Generally, the lid lever stages opening of a vent hole relative to a drink hole so that vapor within the container may be vented to the atmosphere before the drink hole is opened. Thus, the lid lever and the seal arm assembly advantageously reduce or eliminate the possibility of a consumer being sprayed with hot vapor through the drink hole when the drink hole is opened, which could inconvenience, and potentially even injure, the consumer. The seal arm assembly is operatively connected to the cap of the lid so that the seal arm assembly is actuated by pivoting of the lid lever. However, the lid lever is configured to rotate a small amount (typically, about 5° or less) independently of the seal arm assembly to open a vent hole before contacting the seal arm assembly to open the drink hole. Operation of the lid lever and the seal arm assembly will be discussed in more detail below.

Figure 2:
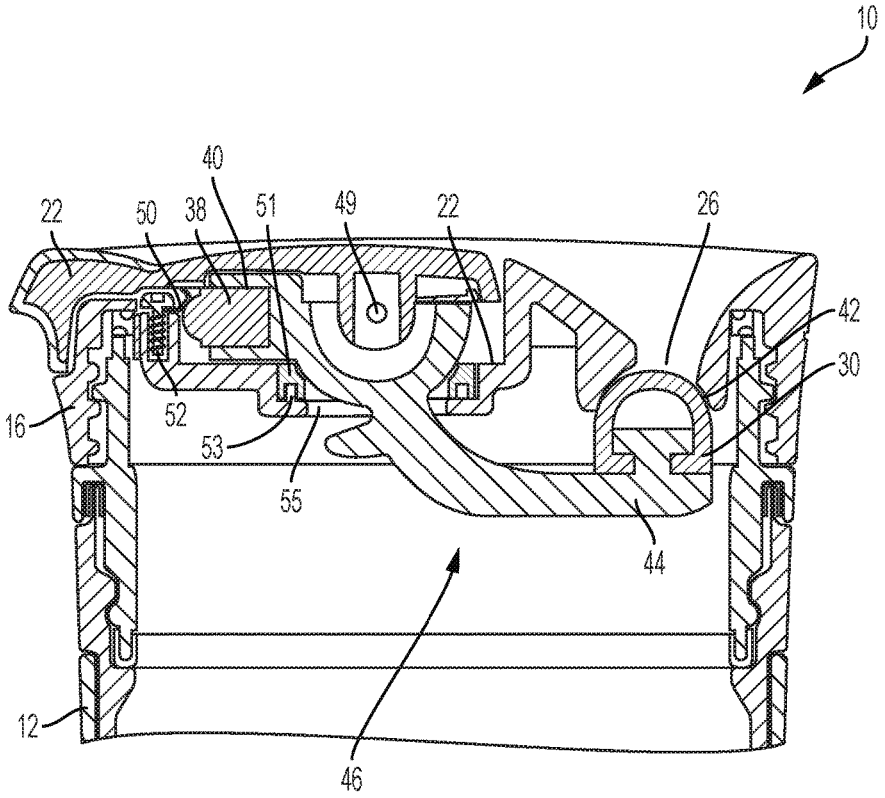
FIG. 2 is a cross-sectional view of the lid of FIG. 1, taken along line 2-2 of FIG. 1.
Figure 3:
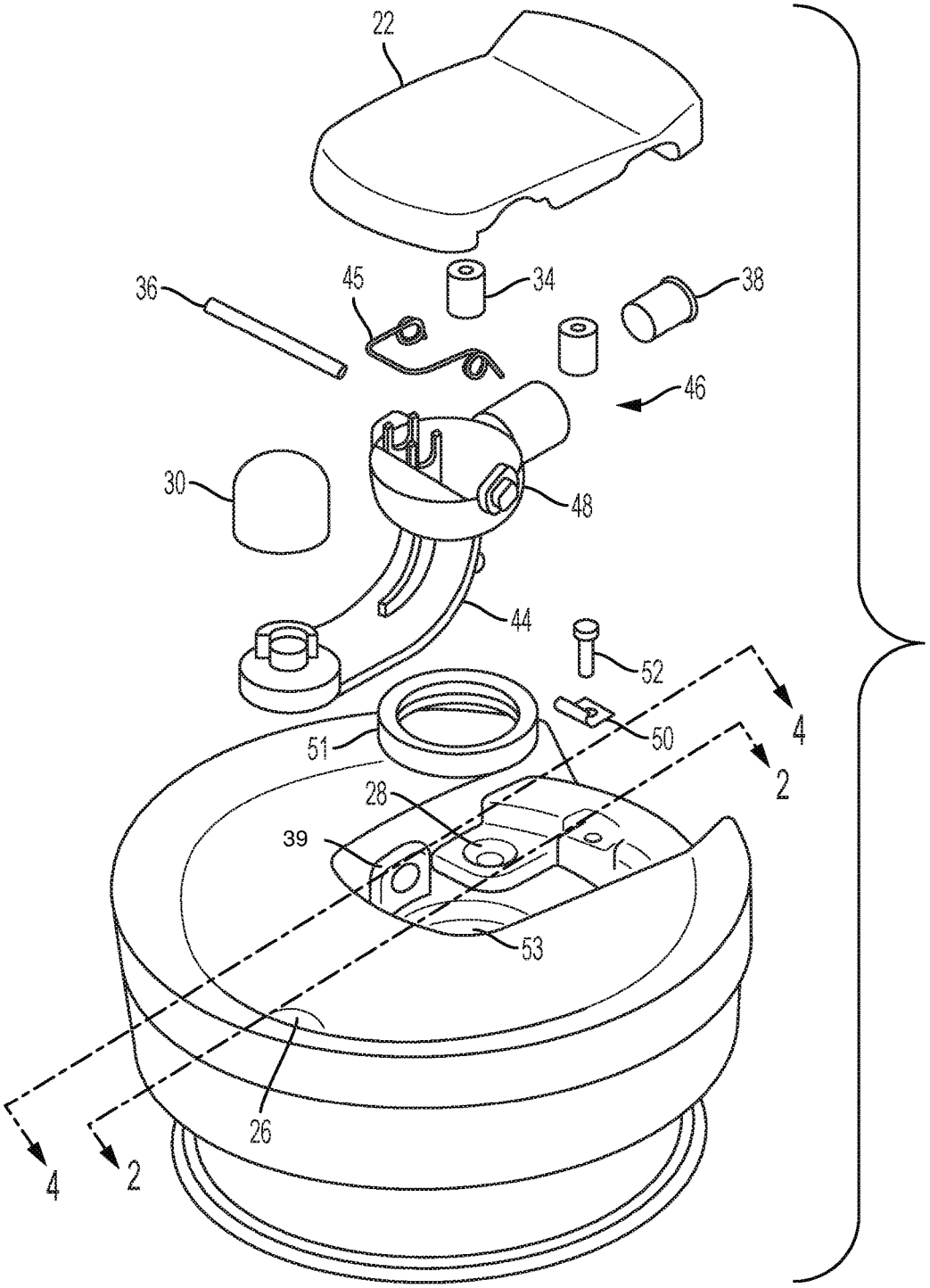
FIG. 3 is an exploded perspective view of the lid of FIG. 2.

Turning now to FIGS. 2 and 3, a cross-sectional view and an exploded view of the lid 10 are illustrated. The cross-sectional view of the lid 10 in FIG. 2 is taken along line 2-2 in FIGS. 1 and 3, which corresponds to a center longitudinal cross-section along a centerline of the lid lever 22. The lid 10 is removably attached to the container 12. In some embodiments, the lid 10 may be removably attached to the container by a threaded connection. In other embodiments, the lid 10 may be removably attached to the container 12 by a snap-on connection. Regardless, the lid 10 may be removed from the container 12 so that the container may be filled with a liquid for consumption.

The base 16 includes a drink hole 26 and one or more vent holes 28. The drink hole 26 and the one or more vent holes 28 fluidly connect the interior of the container 12 to the atmosphere. The drink hole 26 is selectively closed and opened by a drink plug 30 while the one or more vent holes 28 are selectively closed and opened by one or more vent plugs 32, which are described in more detail with respect to FIGS. 4A-4C. The one or more vent holes 28 may include one or more vent seals 34 disposed in the one or more vent holes 28 to facilitate sealing of the vent holes 28 by the vent plugs 32. In one embodiment, the vent seals 34 may be formed from silicone. In other embodiments, the vent seals 34 may be formed from a pliable material, such as an elastomer.

The drink plug 30 seats against a seating surface 42 in a bottom surface of the base 16 in a closed position as shown in FIG. 2. In the disclosed embodiment, the drink plug 30 has a hemispherical shape. In other embodiments, the drink plug 30 may have other shapes, so long as the drink plug 30 is capable of closing the drink hole 26. The drink plug 30 may be mounted at one end of a seal arm 44, which is part of a seal arm assembly 46. The seal arm 44 may be biased by a biasing element, such as a sealing arm spring 45, so that the drink plug 30 is biased towards the closed position. The seal arm assembly 46 includes the seal arm 44, and a rotatable ball element 48. The rotatable ball element 48 is pivotably attached to the lid 10 so that the seal arm 44 may rotate about a pivot point 49. An annular sealing ring 51 may be mounted on an annular ridge 53 formed on the recessed center surface 20 of the lid 10. The annular sealing ring 51 seals the rotatable ball element against the recessed center surface 20 and prevents liquid inside the container 12 from exiting through a central hole 55 in the lid 10.

The lid lever 22 is also pivotably attached to the cap 14 so that the lid lever 22 may rotate about the pivot point 49. The lid lever 22 is also biased to a closed position by the sealing arm spring 45.

In the embodiment illustrated in the figures, both the lid lever 22 and the rotatable ball element 48 are rotatably attached to the lid 10 with a hinge pin 36 and a pair of hinges 39 formed in the lid 10 so that the lid lever 22 and the rotatable ball element 48 rotate about the same pivot point 49. In other embodiments, the lid lever 22 and the rotatable ball element 48 may rotate about different pivot points.

The seal arm assembly 46 includes a ball plunger 38 disposed in a recess 40 formed in, or attached to, the rotatable ball element 48. The ball plunger 38 interacts with a plunger bracket 50 that is secured to the base 16 with a fastener, such as a screw 52. In other embodiments, other fasteners may be used, or the plunger bracket 50 may be attached in other ways, such as with adhesives, or the plunger bracket 50 may be integrally formed with the base 16. The plunger bracket 50 resists movement so that the ball plunger 38 cannot pass the plunger bracket 50 until sufficient force is applied to cause the ball plunger 38 to move away from the plunger bracket 50, thus allowing the ball plunger 38 to pass the plunger bracket 50, which in turn allows the seal arm 44 to rotate. In some embodiments, sufficient force is between 0.7 kg of force and 1.4 kg of force, which is capable of preventing accidental actuation and yet easily applied when intentionally actuated. In yet other embodiments sufficient force is between 0.5 kg of force and 3.0 kg of force. When the seal arm assembly 46 is in the closed position, the plunger bracket 50 and ball plunger 38 maintain the closed position in the absence of a force sufficient to cause the ball plunger 38 to move away from the plunger bracket 50.

Figure 4A:
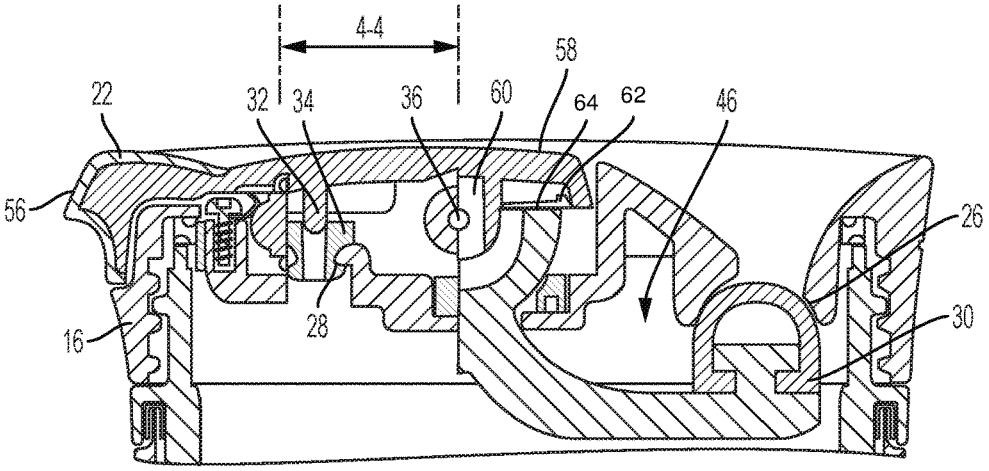
FIG. 4A is a cross-sectional view of the lid of FIG. 1, taken along lines 2-2 and 4-4 of FIGS. 1 and 3, the lid lever and the seal arm assembly being in a closed position.
Figure 4B:
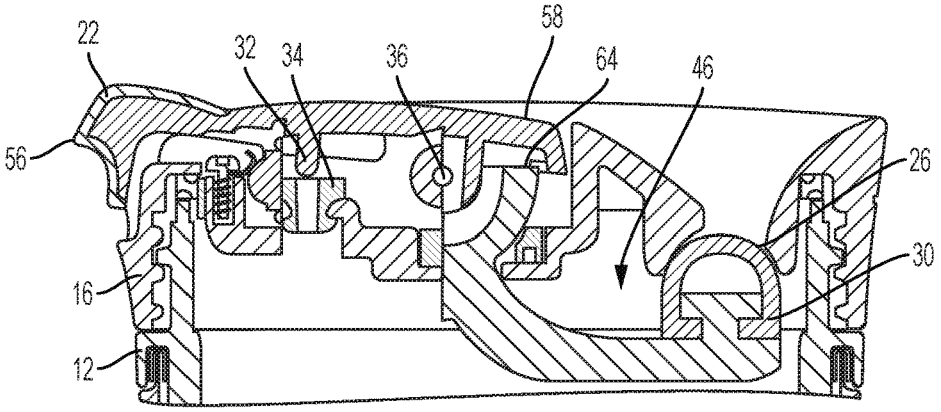
FIG. 4B is a cross-sectional view of the lid of FIG. 1, taken along lines 2-2 and 4-4 of FIGS. 1 and 3, the lid lever being in a pre-vent position and the seal arm assembly being in a closed position.
Figure 4C:
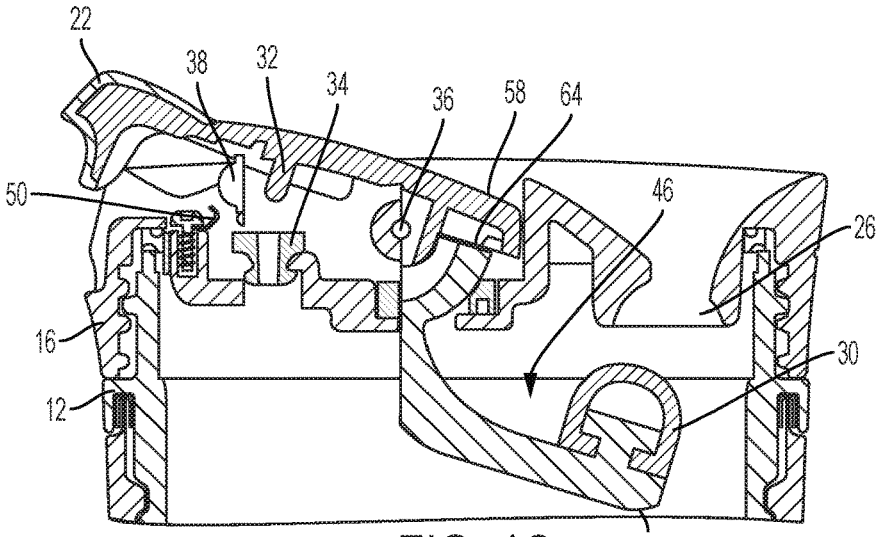
FIG. 4C is a cross-sectional view of the lid of FIG. 1, taken along lines 2-2 and 4-4 of FIGS. 1 and 3, the lid lever and the seal arm assembly being in an open position.

Turning now to FIGS. 4A-4C, opening actions of the lid lever 22 and of the seal arm assembly 46 are further described and illustrated. FIGS. 4A-4C generally illustrate a cross-sectional view of the lid 10, similar to the view of FIG. 2, taken along lines 2-2 in FIGS. 1 and 3. However, a short section of each of FIGS. 4A-4C is offset from line 2-2 and is taken along lines 4-4 in FIGS. 1 and 3. This section is expressly identified in FIG. 4A only, but is also shown in FIGS. 4B and 4C. The portion taken along line 4-4 is illustrated to show the opening action of the vent holes 28 and the relationship between the lid lever 22 and the seal arm assembly 46.

FIG. 4A illustrates a closed position for both the lid lever 22 and the seal arm assembly 46. The lid lever 22 includes an outer tab 56 and an inner extension 58 (outer and inner being used relative to a center of the lid 10) on opposing sides of a hinge 60. The one or more vent plugs 32 project downwardly, from a bottom surface of the lid lever 22 towards the base 16 of the lid 10 and thus towards a bottom of the container 12. In the closed position, which is illustrated in FIG. 4A, the one or more vent plugs 32 are inserted, at least partially, into central bores of the one or more vent seals 34, which in turn are located in the one or more vent holes 28. The one or more vent plugs 32 thus seal the one or more vent holes 28, thereby preventing fluid and/or gases within the container 12 from escaping to the atmosphere through the one or more vent holes 28.

The outer tab 56 extends over a portion of the base 16, and the inner extension 58 at least partially covers the rotatable ball element 48. A small gap 62 is formed between the inner extension 58 and a shoulder 64 of the rotatable ball element 48. The small gap 62 allows independent movement of the lid lever 22, for at least a short distance, before contacting the rotatable ball element 48 to move the seal arm 44.

Turning now to FIG. 4B, which illustrates a partially open position for the lid lever 22 and a closed position for the seal arm assembly 46, as a consumer begins to open the lid lever 22, the outer tab 56 is raised relative to the base 16, which causes the lid lever 22 to pivot (in a clockwise direction in FIG. 4B) about the hinge pin 36. As the outer tab 56 is raised, the lid lever 22 pivots independently of the seal arm assembly 46 for a short distance (typically, corresponding to rotational movement of about 5° or less, for example, between about 5° and about 1°, or about 3°), and the one or more vent plugs 32 separate from the one or more vent seals 34, thereby venting gases within the container 12 through the one or more vent seals 34 while the seal arm assembly 46 remains in the closed position with the drink plug 30 sealing the drink hole 26. After about 1° to about 5° of rotational movement of the lid lever 22, the inner extension 58 contacts the rotatable ball element 48, for example at the shoulder 64 on the rotatable ball element 48.

Turning now to FIG. 4C, which illustrates a fully open position for both the lid lever 22 and the seal arm assembly 46, after the inner extension 58 contacts the shoulder 64, and as a consumer continues to push upward on the outer tab 56, sufficient force is generated to overcome the interaction between the ball plunger 38 and the plunger bracket 50 and the ball plunger 38 slides over the plunger bracket 50 while the seal arm 44 rotates about the hinge pin 36 (clockwise in FIG. 4C) away from the drink hole 26 so that the drink plug 30 exposes the drink hole 26. As a result, liquid from inside the container 12 may flow through the drink hole 26 and be consumed or otherwise extracted by the consumer. The lid lever 22 and the seal arm assembly 46 rotate together after the inner extension 58 contacts the shoulder 64. The lid lever 22 and the seal arm assembly 46 are held in the open position illustrated in FIG. 4C by the consumer maintaining an upward force on the outer tab 56 that is sufficient to counter the force generated by the sealing arm spring 45 (FIG. 3).

Once the consumer releases the outer tab 56, the seal arm assembly 46 rotates about the pivot pin 36 (counterclockwise in FIGS. 4A-4C) due to the force generated by the sealing arm spring 45, which is now unopposed. The seal arm assembly 46 also forces the lid lever 22 to rotate about the pivot pin 36 (counterclockwise in FIGS. 4A-4C) due to the contact between the inner extension 58 and the shoulder 64 until the ball plunger 38 contacts the plunger bracket 50. At this point, the drink plug 30 remains spaced apart from the drink hole 26 so that the drink hole 26 remains open and liquid from inside the container 12 is accessible through the drink hole 26. Additionally, the plunger bracket 50 prevents the seal arm assembly 46 and the lid lever 22 from rotating any further, which prevents the one or more vent plugs 32 from contacting the one or more vent seals 34, thereby allowing gases from within the container 12 to continue to vent to the atmosphere.

To fully close the lid 10, the consumer pushes down on the outer tab 56 until sufficient force is generated to overcome the interaction between the plunger bracket 50 and the ball plunger (as described above), which allows the ball plunger 38 to move into the fully closed position. This movement also brings the one or more vent plugs 32 into contact with the one or more vent seals 34, and brings the drink plug 30 into contact with the drink hole 26, thereby sealing the one or more vent holes 28 and the drink hole 26. Moreover, as the ball plunger 38 slides past the plunger bracket 50, the consumer is given a tactile indication and an audible indication (i.e., a "click") that the lid 10 is in the fully closed position.

The disclosed lid advantageously sequentially opens a vent hole before opening a drink hole to prevent pressurized vapor within a container from forcefully exiting the drink hole as a consumer begins to drink from the container. The vent hole is sequentially opened first through the rotation of a lid lever, before the drink hole is opened by the rotatable ball element.

While various embodiments have been described above, this disclosure is not intended to be limited thereto. Variations can be made to the disclosed embodiments that are still within the scope of the appended claims.

What is claimed is:

1. A lid for a liquid container, the lid comprising:

a base that is configured for removable attachment to a container, the base including one or more vent holes and a drink hole;

a lid lever pivotably attached to the base, the lid lever including one or more vent plugs that selectively open and close the one or more vent holes; and a seal arm assembly pivotably attached to the base and pivotably movable about a pivot point, the seal arm assembly including a drink plug that selectively opens and closes the drink hole, wherein the seal arm assembly includes a ball plunger located in a recess that is formed in, or is connected to, a ball element, and wherein, beginning in a closed position, the lid lever is pivotably movable independently of the seal arm assembly to open the at least one vent hole before the lid lever contacts the seal arm assembly to open the drink hole.

2. The lid of claim 1, wherein the lid lever is pivotably movable 5° or less from a closed position before contacting the seal arm assembly.

3. The lid of claim 1, further comprising a plunger bracket located on the base, the plunger bracket resisting movement, so as to prevent the ball plunger from passing the plunger bracket until sufficient force is applied, thereby only allowing the seal arm assembly to move from a closed position to an open position when sufficient force is applied.

4. The lid of claim 3, wherein between 0.5 kg of force and 3.0kg of force is required to cause the ball plunger to move away from the plunger bracket, which allows the ball plunger to pass the plunger bracket.

5. A lid for a container, the lid comprising:

a base that is configured for removable attachment to a container, the base including one or more vent holes and a drink hole;

a lid lever pivotably attached to the base, the lid lever including one or more vent plugs that selectively open and close the one or more vent holes; and a seal arm assembly pivotably attached to the base and pivotably movable about a pivot point, the seal arm assembly including a drink plug that selectively opens and closes the drink hole, wherein, beginning in a closed position, the lid lever is pivotably movable independently of the seal arm assembly to open the at least one vent hole before the seal arm assembly opens the drink hole, and wherein the lid lever and the seal arm assembly pivot about a common hinge pin.

6. The lid of claim 5, wherein the lid lever includes an external tab and an inner extension, the external tab and the inner extension being located on opposing sides of the common hinge pin.

7. The lid of claim 6, wherein the seal arm assembly includes a rotatable ball element having a shoulder and, after moving the lid lever to open the vent hole, the inner extension of the lid lever contacts the shoulder of the ball element to cause the lid lever and the seal arm assembly to move in unison.

8. The lid of claim 6, wherein the at least one vent plug extends away from a surface closest to the base, and towards an interior of a container, the at least one vent plug being located on the same side of the common hinge pin as the external tab.

9. The lid of claim 6, further comprising one or more vent seals located in the one or more vent holes.

10. The lid of claim 9, wherein the one or more vent seals are formed from a silicone material.

11. A liquid container comprising:

a container body having a central chamber and an open end;

a lid having a base that is configured for removable attachment to the open end of the container, the base including at least one vent hole and a drink hole;

a lid lever pivotably attached to the base, the lid lever including at least one vent plug that selectively opens and closes the at least one vent hole; and a seal arm assembly pivotably attached to the base and pivotably movable about a pivot point, the seal arm assembly including a drink plug that selectively opens and closes the drink hole, wherein the lid lever and the seal arm assembly pivot about a common hinge pin, and wherein the lid lever is pivotably movable independently of the seal arm assembly to open the at least one vent hole before the lid lever contacts the seal arm assembly to open the drink hole.

12. The liquid container of claim 11, wherein the lid lever is pivotably movable 5° or less from a closed position before contacting the seal arm assembly.

13. The liquid container of claim 11, wherein the lid lever includes an external tab and an inner extension, the external tab and the inner extension being located on opposing sides of the common hinge pin.

14. The liquid container of claim 13, wherein the seal arm assembly includes a rotatable ball element and, after moving the lid lever to open the vent hole, a shoulder and the inner extension of the lid lever contacts the shoulder of the ball element to cause the lid lever and the seal arm assembly to move in unison.

15. The liquid container of claim 13, wherein the at least one vent plug extends away from a surface closest to the base and towards from an interior of the container, the at least one vent plug being located on the same side of the common hinge pin as the external tab.

16. The liquid container of claim 13, further comprising one or more vent seals located in the one or more vent holes.

17. The liquid container of claim 11, wherein the seal assembly includes a ball plunger located in a recess in a ball element.

18. The liquid container of claim 17, further comprising a plunger bracket located on the base, the plunger bracket resisting movement, so as to prevent the ball plunger from passing the plunger bracket until sufficient force is applied, thereby only allowing the seal arm assembly to move from a closed position to an open position when sufficient force is applied.

* * * * *